United States Patent [19]

Barinov et al.

[11] Patent Number: 4,862,720

[45] Date of Patent: Sep. 5, 1989

[54] APPARATUS FOR MAKING WIRE SPRINGS

[76] Inventors: Alexei P. Barinov, ulitsa, 99a, kv. 29, Barnaul, Vodoprovodnaya; Viktor A. Bazin, ulitsa Chernyshevskogo, 30, kv. 6, Barnaul; Vladislav I. Maxak, ulitsa Krylova, 90, kv. 36; Vasily N. Rakityansky, Trudovaya ulitsa, 11, kv. 38, both of Krasnoyarsky krai, Abakan, all of U.S.S.R.

[21] Appl. No.: 153,214

[22] Filed: Feb. 8, 1988

[51] Int. Cl.[4] ..... B21F 3/04

[52] U.S. Cl. ..... 72/144

[58] Field of Search ..... 72/135, 138, 140, 142, 72/143, 144, 145, 371

[56] References Cited

U.S. PATENT DOCUMENTS 4,736,606 4/1988 Barinov et la. ..... 72/144

*Primary Examiner*—E. Michael Combs

*Attorney, Agent, or Firm*—Lilling & Greenspan

[57] ABSTRACT

This invention relates to plastic metal working. The apparatus embodying the invention, includes two parallel oppositely directed mandrels secured each by one end in a collet clamp and by the other end in a rotating sleeve, and two assemblies for winding springs from a respective wire onto the corresponding mandrel, these two assemblies being mounted on a common carriage to move lengthwise of the mandrels. Each spring winding assembly has a mechanism for setting the helic angle of the spring being wound.

7 Claims, 7 Drawing Sheets

APPARATUS FOR MAKING WIRE SPRINGS

BACKGROUND OF THE INVENTION

This invention relates to plastic metal working, and more particularly to an apparatus for making wire springs.

The invention can be used most advantageously in mechanical engineering for making springs of relatively small coil diameter from a wire gauging 1.8 to 3.0, including coiling expander spring of channel oil-control piston rings, and closed-coil springs, particularly for making Bowden cables.

DESCRIPTION OF THE PRIOR ART

There is known an apparatus for main wire springs disclosed in a copending U.S. patent application filed by the same inventors under Ser. No. 85,343.

This known apparatus includes two parallel oppositely directed mandrels secured each by one end in a collet clamp and by the other end in a rotating sleeve. The apparatus also includes two spring winding assemblies on a common carriage movable along the mandrels to coil the wire thereon.

Each such assembly comprises a casing having a recess to accommodate the mandrel with two steps one of which includes a portion of the mandrel having the wire being wound thereon, and a die to direct the wire onto the mandrel having an outlet hole opening on a boundary between the steps of the recess.

In this known apparatus the helix angle of the spring is set by the die of the spring winding assembly, which is not adjustable during operation.

Therefore, for each type and size of the spring and for setting of the desired helix angle a special spring winding assembly is necessary.

In addition, the die is subject to wear in the course of operation. Since wear of the die is not compensated for, the helix angle of the spring tends to reduce the affect the quality of springs being coiled.

SUMMARY OF THE INVENTION

It is the principle object of the invention to provide an apparatus for making wire springs ensuring coiling springs of different helix angles and pitch.

Another object is to provide an apparatus for making wire springs of high quality.

These and other objects are attained by an apparatus for making wire springs comprising a base accommondating two collet clamps and two sleeves having separate drives for their rotation, two parallel mandrels secured each by one end thereof in the collet clamp and by the other end in the rotating sleeve, and two assemblies for winding a spring from a wire onto the corresponding mandrel mounted on a common carriage to move lengthwise of the mandrels, each such spring winding assembly including a casing having a recess to accommodate the mandrel with two steps in the recess, one step accommodating a portion of the mandrel having the spring being wound thereon, and a die for directing the wire to the mandrel having an outlet hole opening on a boundary between the steps of the recess. According to the invention, each assembly for winding the spring is provided with a mechanism for setting the helix angle of the spring disposed in the recess of the casing.

Preferably, each mechanism for setting the helix angle of the spring comprises a comb arranged lengthwise of the mandrel in the recess of the casing of the spring winding assembly and having grooves directed at an angle to a line perpendicular to the axis of the mandrel equal to the helix angle of the spring and spaced at a pitch equal to the pitch of the spring, a slide provided at the side of the base of the comb for reciprocations along the axis of the mandrel from a drive, and a cylindrical rod element secured in the body of the slide for free turning relative to its axis perpendicular to the axis of the mandrel and having a hole disposed perpendicularly to the axis of turning of the rod element and aligned in cross-section with the hole of the die.

In order to compensate for wear of the comb teeth, the drive for imparting reciprocations to the slide can be fashioned as a lead screw locked in a casing of the spring winding assembly against longitudinal displacement and linked with the slide by a threaded connection.

For winding springs of variable pitch it is preferable that each mechanism for setting the helix angle of the spring comprises a U-shaped slide capable of reciprocations along the axis of the mandrel from a drive and having a recess for accommodating two pressure inserts whose cylindrical surfaces face the mandrel, the radius of curvature of these surfaces being equal to the radius of curvature of the outer surface of the spring, one of the inserts having at its end face a bearing shoulder of a height equal to the diameter of the wire to cooperate with the last coil of the spring, and a cylindrical rod element capable of free turning relative to its axis perpendicular to the axis of the mandrel and having a hole arranged perpendicularly to the axis of turning of the rod element and aligned in cross-section with the hole of the die.

It is also preferable for reasons of simplicity that the drive of the U-shaped slide have the form of a power cylinder whose rod accommodates a screw engageable with the end face of the slide.

In order to ensure winding of springs with smoothly changing pitch through the spring length it is advisable that each mechanism for setting the helix angle of the spring comprise a pusher member one end of which has a tapered surface, whereas the other end thereof has a roller capable of rotation about its own axis, a follower continuously engaging by its working surface with the outer cylindrical surface of the roller, and a rotatable dog secured by one end thereof in a casing of the spring winding assembly and having an axis of rotation perpendicular to the axis of the mandrel, the other end thereof continuously cooperating with the tapered surface of the pusher member, and having a longitudinal groove accommodating a stop element engageable with the last coil of the spring and transmitting a force from the spring being wound to the casing of the spring winding assembly.

Alternatively, the stop element can be fashioned as a plate disposed in the groove of the rotatable dog, adjoining by one surface thereof the inner surface of the groove, and having a tapered hole for accommodating the mandrel, the axis of rotation of the dog coinciding with the axis of the mandrel.

In order to ensure that the stop element be more reliable during operation, it is preferably fashioned as a roller secured in the casing of the dog and having an axis of rotation spaced from the axis of rotation of the dog at a distance equal to the radius of the roller an end face of which is spaced from the axis of the mandrel at a distance equal to the radius of the mandrel, whereas its cylindrical surface engages with the last coil of the spring.

BRIEF DESCRIPTION OF THE DRAWINGS

The invention will now be described in greater detail with reference to various specific embodiments thereof taken in conjunction with the accompanying drawings, in which.

DESCRIPTION OF THE PREFERRED EMBODIMENTS

Statics

Figure 1:
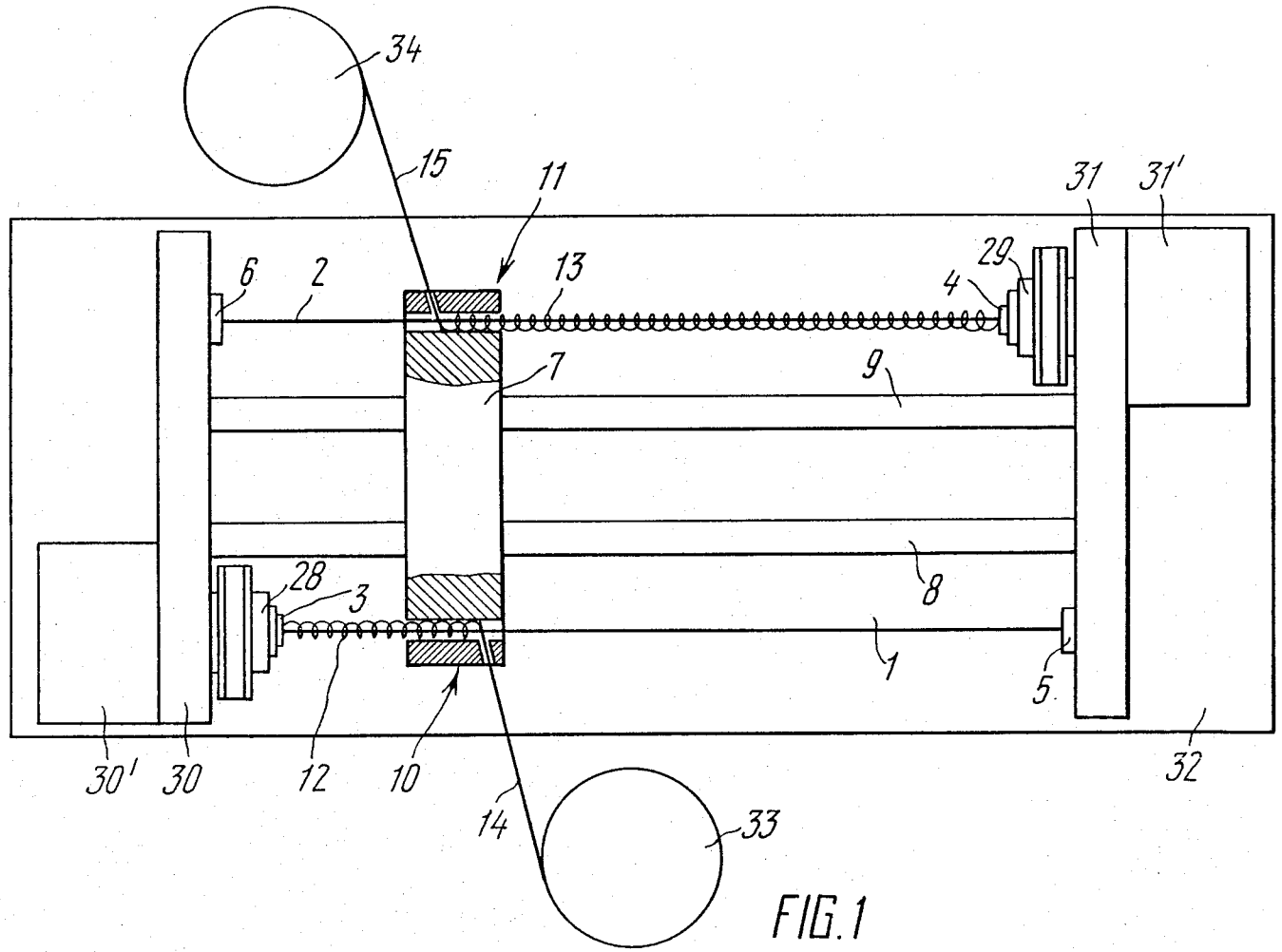
FIG. 1 is a top plan partially cut-away view of an apparatus for making wire springs according to the invention.

The proposed apparatus for making wire springs represented in FIG. 1 comprises mandrels 1 and 2 arranged in parallel but in the opposite directions, these mandrels 1 and 2 being secured at one end in collet clamps 3 and 4, respectively, and at the other end in rotating sleeves 5 and 6 and two assemblies 10 and 11 for winding springs 12 and 13 from wires 14 and 15 onto the respective mandrels 1 and 2, these two assemblies being secured on a common carriage 7 to be capable of movement lengthwise of the mandrels 1 and 2 along guides 8 and 9. Each assembly 10, 11 includes a casing 16 (FIG. 2), 17 having a recess 18, 19, respectively, for accommodating the respective mandrel 1, 2.

Each recess 18, 19 has two steps, particularly, the recess 18 has steps 20 and 21, whereas the recess 19 has steps 22 and 23, the step 21 of the recess 18 having a portion 24 of the mandrel 1 with a spring 12 from the wire 14 wound thereon, the step 22 of the recess 19 accommodating a portion 25 of the mandrel 2 with a spring 13 from the wire 15 wound thereon.

In addition, each recess 18, 19 comprises a die 26, 27, respectively, extending to and having an outlet hole at a boundary between the respective steps 20 and 21, 22 and 23.

The collet clamps 3 (FIG. 1) and 4 are arranged in spindles 28 and 29 of spindle assemblies 30 and 31. Provided on the spindle assemblies 30 and 31 are power cylinders 30' and 31' arranged with drives (not shown) for rotating the spindles 28 and 29 on a common base 32. The wires 14 and 15 for making springs 12 and 13 are wound onto coils 33 and 34.

According to the invention, each spring winding assembly 10 and 11 is provided with a mechanism for setting the helix angle of the spring accommodated in the respective recess 18 and 19 of the corresponding casing 16 and 17.

Figure 3:
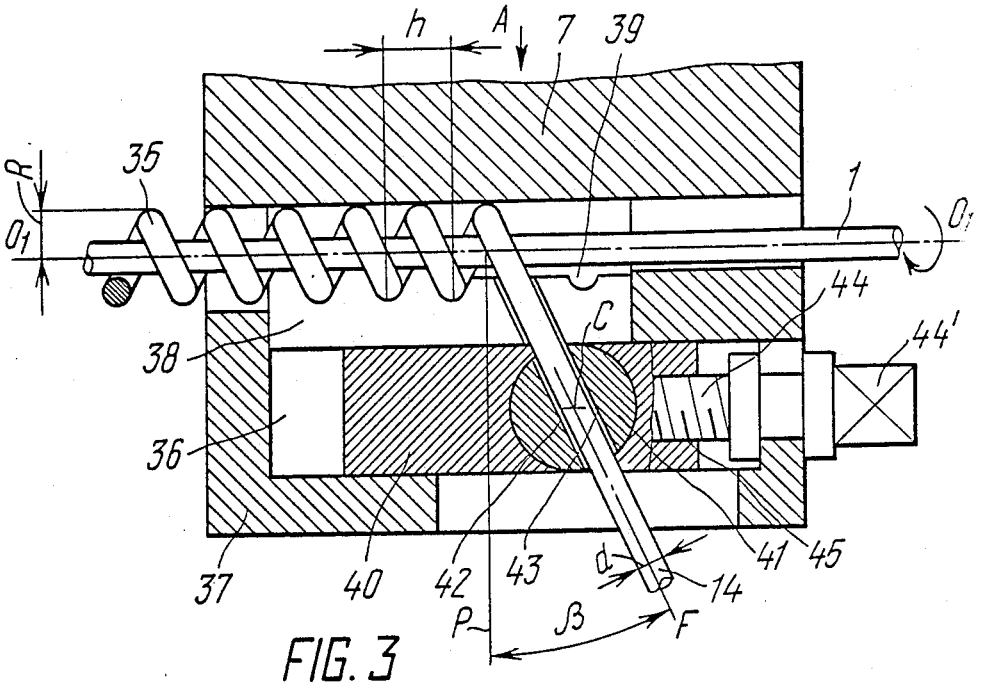
FIG. 3 is an enlarged section in the horizontal plane of a modified form of a mechanism for setting the helix angle of the spring with a reciprocating drive for imparting movement to a slide.
Figure 4:
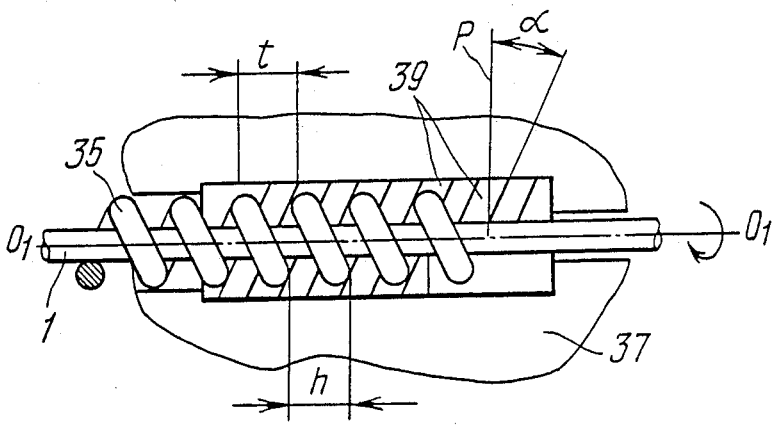
FIG. 4 is a view along the arrow A in FIG. 3.

The mechanism for setting the helix angle of the spring 35 represented in FIG. 3 accommodates a comb 38 arranged lengthwise of the mandrel 1 in a recess 36 of a casing 37 of the spring winding assembly of the spring 35, this comb 38 having grooves 39 arranged relative to a line P perpendicular to the axis $O_1O_1$ of the mandrel 1 at an angle $\alpha$ (FIG. 4) equal to the helix angle $\beta$ (FIG. 3) of the spring 35 and a pitch t equal h of the spring 35. In addition, this mechanism includes a slide 40 mounted inside the casing 37 at the side of the base of the comb 38 to reciprocate along the axis $O_1$—$O_1$ of the mandrel 1 from a drive, and a rod element 41 of cylindrical shape arranged inside the body of the slide 40 for free turning relative to its axis C—C perpendicular to the axis $O_1$—$O_1$ of the mandrel 1. The slide 40 has a hole 42 arranged perpendicularly to the axis C—C of turning of the rod element 41 and aligned cross-sectionally with the hole of a die 43 to direct the wire 14 to the mandrel 1.

The drive for imparting reciprocating motion to the slide 40 includes a lead screw 44 affixed by a nut 44' in the casing 37 of the spring winding assembly against longitudinal travel and connected to the slide 40 by a threaded connection 45.

Figure 5:
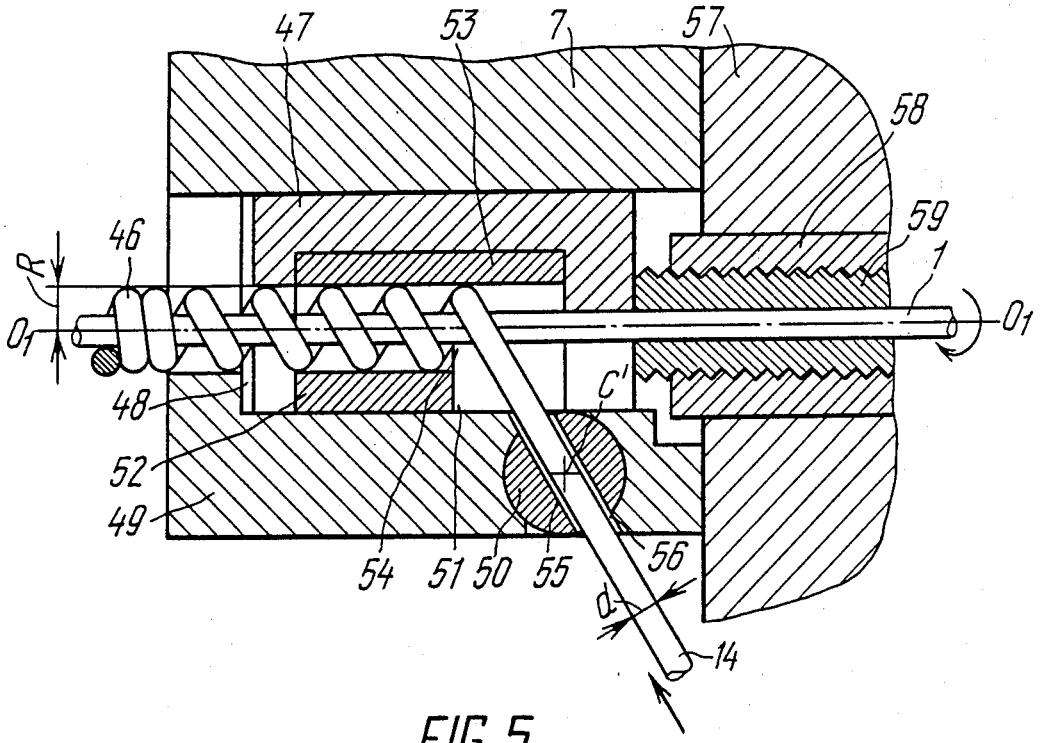
FIG. 5 is a longitudinal sectional view in the horizontal plane of another embodiment of the mechanism for setting the helix angle of the spring with a drive of a U-shaped slide.

FIG. 5 shows a mechanism for setting the helix angle of a spring 46, which includes a slide 47 in the form of an inverted U, and an assembly for winding the spring 46 from the wire 14 arranged inside a recess 48 of a casing 49 to be capable of reciprocations along the axis $O_1$—$O_1$ of the mandrel 1 from the drive, and a rod element 50 of cylindrical shape arranged in the casing 49 of the spring winding assembly to be capable of free turning relative to its own axis C'—C' perpendicular to the axis $O_1$—$O_1$ of the mandrel 1.

The U-shaped slide 47 has a recess 51 to accommodate two pressure inserts 52 and 53 having cylindrical surfaces facing the spring 46 of a curvature radius equal to the radius R of curvature of the outer surface of the spring 46.

One end face of the inserts 52 has a bearing shoulder 54 of a height equal to the diameter d of the wire 14 and engageable with the last coil of the spring 46.

The rod element 50 has a hole 55 arranged substantially perpendicularly to the axis C'—C' of turning of the rod 50 and aligned in cross-section with the hole of the die 56 for directing the wire 14 to the mandrel 1.

The drive of the U-shaped slide 47 has the form of a power cylinder 57, a rod 58 which accommodates a screw 59 engageable with the end face of the slide 47.

Figure 6:
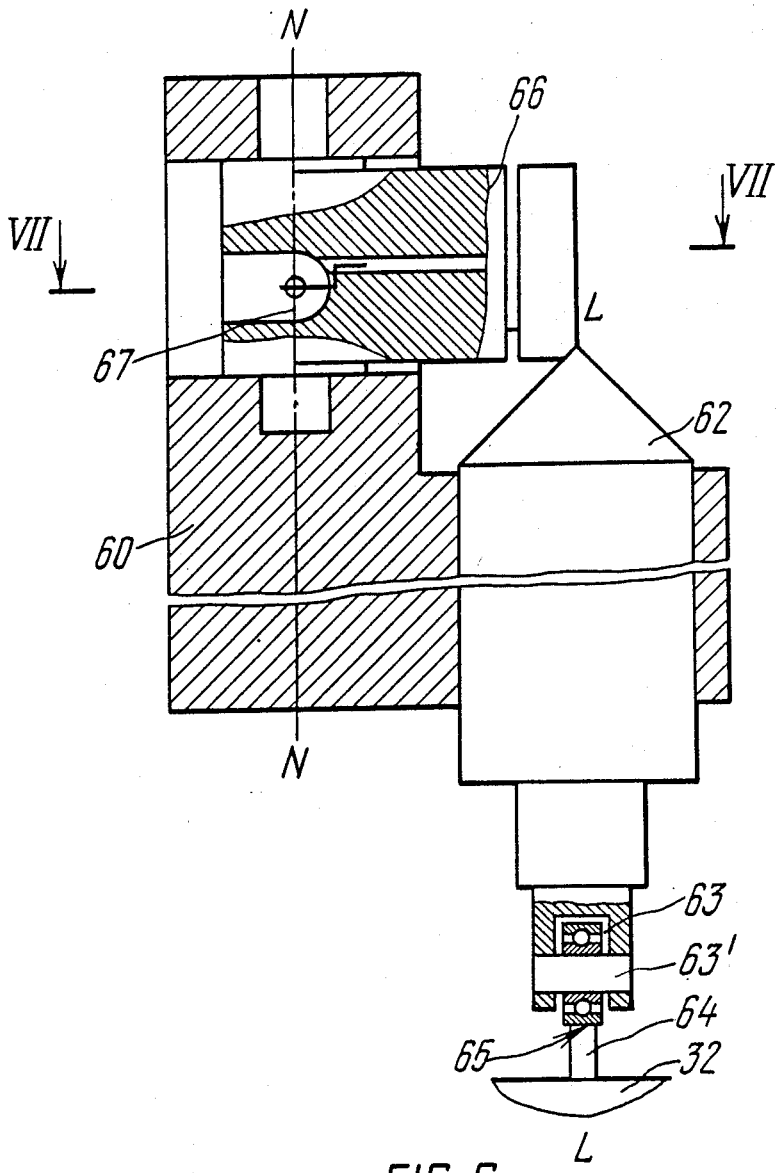
FIG. 6 is a longitudinal sectional view in the horizontal plane of another alternative modification of the mechanism for setting the helix angle of the spring.

FIG. 6 illustrates one more embodiment of the mechanism for setting the helix angle of the spring, which comprises a pusher member 62 mounted inside a casing 60 of an assembly for winding a spring 61 (FIG. 7) from the wire 14. At one end the pusher member 62 has a tapered surface, whereas the other end of the pusher member 62 has a roller 63 capable of rotation about its own axis. The mechanism further includes a follower 64 continuously engaging by its working surface 65 with the outer cylindrical surface of the roller 63, a rotatable dog 66 secured in a cantilever fashion in the casing 60 of the spring winding assembly, and a stop element engageable with the last coil of the spring 61 and transmitting a force from the spring 61 being wound to the casing 60 of the spring winding assembly.

The dog 66 has an axis N—N of turning substantially perpendicular to the axis $O_1$—$O_1$ of the mandrel 1 and also has a longitudinally extending groove 67 accommodating the stop element. The free end of the rotatable dog 66 is adapted to continuously cooperate with the tapered surface of the pusher member 62.

The stop element has the form of a plate 68 (FIG. 7) accommodated in the groove 67 of the rotatable dog 66. The plate 68 is in contact by one of its surfaces 69 with the inner surface of the groove 67 and has a tapered hole 70 to accommodate the mandrel 1; the axis N—N of turning of the dog 66 coinciding with the axis $O_1$—$O_1$ of the mandrel 1 and with a surface 71 of the plate 68 opposite to the surface 69 adjacent to the surface of the groove 67.

Figure 8:
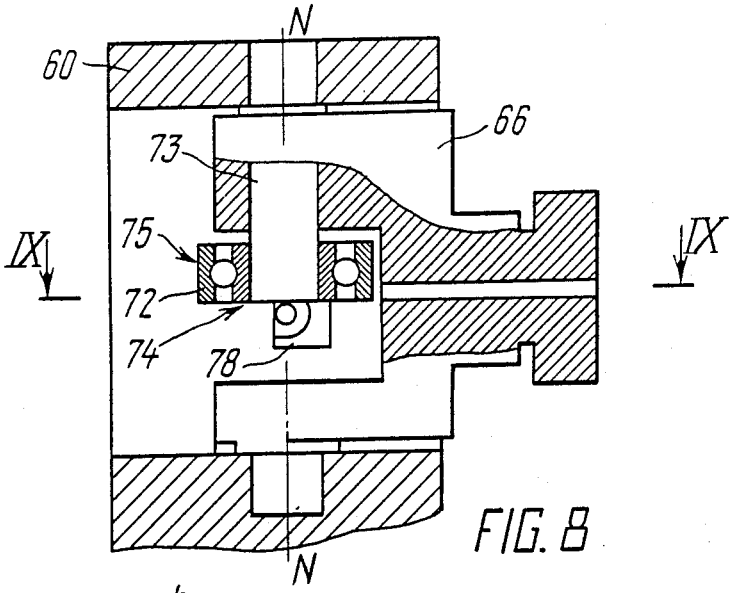
FIG. 8 is a longitudinal sectional view in the horizontal plane of an alternative embodiment of the mechanism for setting the helix angle of the spring shown in FIG. 5, in which a bearing element has the form of a roller.
Figure 9:
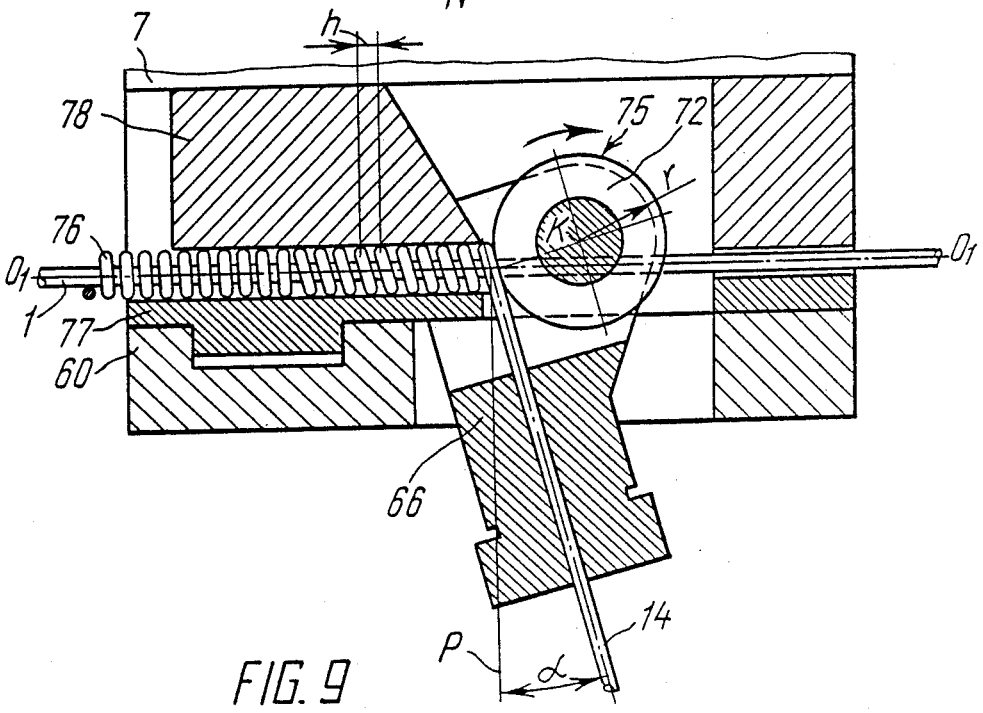
FIG. 9 is a section taken along the line IX—IX in FIG. 8.

The stop element shown in FIG. 8 is fashioned as a roller 72 secured in the casing of the dog 66 on the axis 73 and having a rotation center K (FIG. 9) spaced at a distance from the axis N—N of turning of the dog 66 equal to the radius r of the roller 72. Therewith, end face 74 (FIG. 8) of the roller 72 is spaced from the axis $O_1$—$O_1$ of the mandrel 1 at a distance equal to the radius of the mandrel 1, whereas a cylindrical surface 75 of the roller 72 engages with the last coil of the spring 76 (FIG. 9).

In addition, the spring winding assembly comprises a bearing insert 77 to which the spring 76 is pressed in the course of winding, and an insert 78 acting to force the spring 76 to the bearing insert 77.

Dynamics

Figure 2:
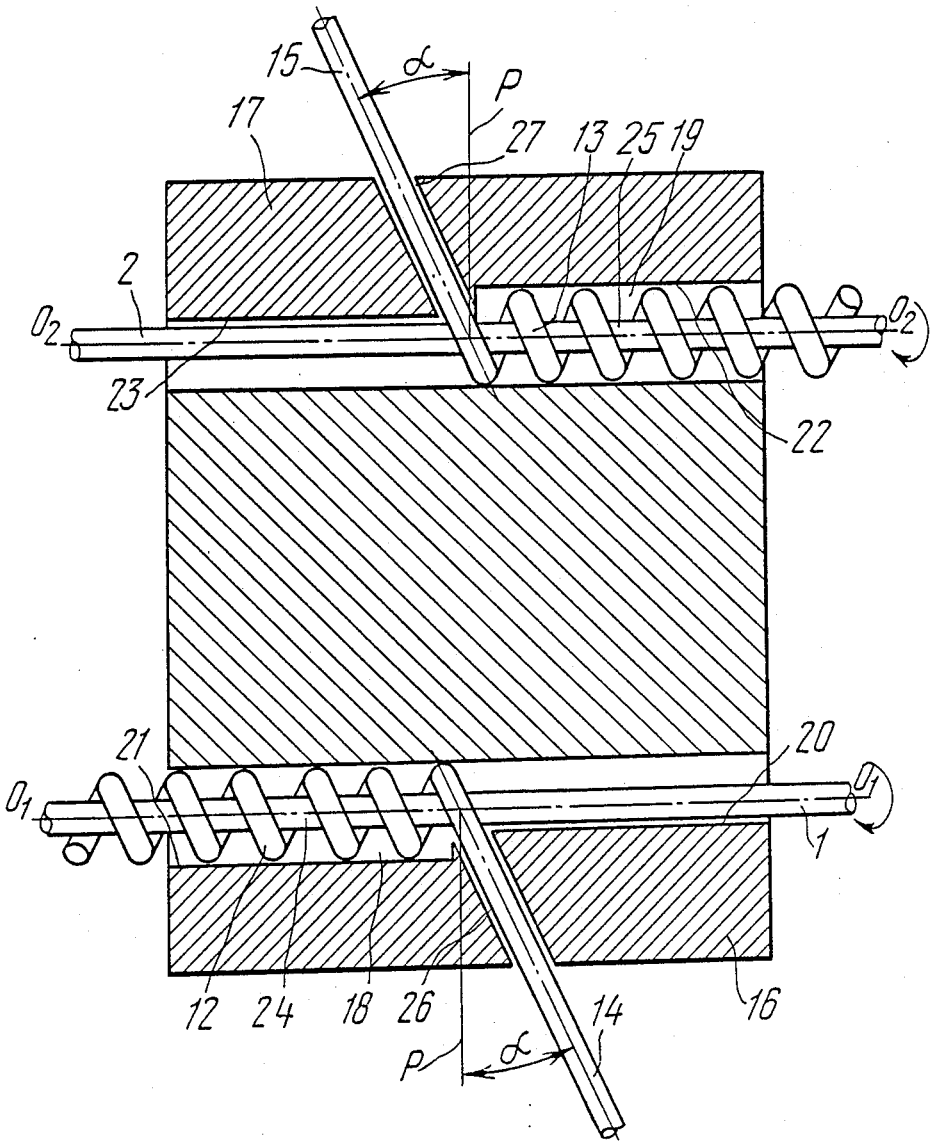
FIG. 2 is an enlarged section in the horizontal plane of a carriage with two spring winding assemblies.

The apparatus for making wire springs operates in the following manner. At first, the apparatus is prepared for operation. The assembly 10 for winding the spring 12 is removed from the carriage 7. The wire 14 is pulled from the coil 33 to be threaded through the die 26 (FIG. 2).

The end of the wire 14 passed through the die 26 is wound manually about a diameter equal to the diameter of the mandrel 1 for a portion of the spring 12 to have a length ensuring reliable attachment in the collet clamp 3 (FIG. 1). The thus wound portion of the spring 12 is placed in the recess 18 of the spring winding assembly 10. Then the assembly 10 is placed on the carriage 7 to be secured thereto such as by screws (not shown).

One end of the mandrel 1 is passed through the wound portion of the spring 12, and the carriage is set to its leftmost position.

Subsequent to setting the carriage 7 in the leftmost position the end of the mandrel 1 is rigidly secured in the rotating sleeve 5 provided in the casing of the spindle assembly 31.

During adjustment the power cylinder 30' acts by its rod (not shown) on the collet 3 to hold the spring 12 with the mandrel 1. From a control panel (not shown) a signal is issued to initiate rotation of the spindles 28 and 29. The spindle 28 starts to transmit rotation or torque to the mandrel 1 having a portion of the spring 12 already wound thereon.

While executing rotation, the mandrel 1 acts to wind the wire 14 passing through the die 26 (FIG. 2) of the spring winding assembly 10 (FIG. 1).

When making the last coil of the spring 12 a force arises between the step 20 of the stepped recess 18 and wire 14 fed through the die 26 to the mandrel 1, this force being directed from the spindle 28 to the spindle 29.

The spring winding assembly 11 imparts this force to the carriage 7, whereby the carriage 7 starts to travel from the spindle 28 to the spindle 29 unit it rests in the rightmost position. In the rightmost position the power cylinder 30' releases the collet clamp 3, after which the transmission of torque from the spindle 30' to the mandrel 1 and spring 12 is terminated. In consequence, winding of the wire 14 on the mandrel 1 is also terminated, the carriage 7 stops, and the spindles 28 and 29 no longer rotate.

The wire 15 is then threaded to the spring winding assembly 11.

The spring winding assembly 11 is removed from the carriage 7, the wire 15 is pulled from the coil 34 and passed through the die 27 (FIG. 2).

The end of the wire 15 passed through the die 27 is wound manually into a coil of a diameter substantially equal to the diameter of the mandrel 2 to make a portion of the spring 13 having a length ensuring its reliable attachment in the collet clamp 4 (FIG. 1).

The thus wound portion of the spring 13 is placed in the recess 19 of the spring winding assembly 11, which is then placed on the carriage 7 and secured thereto by screws (not shown).

One end of the mandrel 2 is passed through the wound portion of the spring 13 (the carriage 7 resting in the rightmost position). The mandrel 2 is rigidly secured in the rotating sleeve 6 of the spindle assembly 30.

When adjusting the apparatus, the power cylinder 30' acts by its rod (not shown) on the collet clamp 4 to hold the spring 13 with the mandrel 2. A signal is delivered from a control panel (not shown) to initiate rotation of the spindles 28 and 29. The spindle 28 starts to transmit torque to the mandrel 2 having a portion of the spring 13 already wound thereon.

The mandrel 2 rotates for the wire 15 passing through the die 27 (FIG. 2) of the wire winding assembly 11 to be wound thereon.

When the last coil of the spring 13 is wound between the step 23 of the stepped recess 19 and the wire 15 conveyed through the die 27 to the mandrel 2, a force is produced directed from the spindle 29 to the spindle 28.

The wire winding assembly 11 transmits this force to the carriage 7 to move this carriage 7 from the spindle 29 to the spindle 28 to the leftmost position. In the leftmost position the power cylinder 31' releases the collet 4. Transmission of torque from the spindle 29 to the mandrel 2 and spring 13 is terminated, whereby winding of the wire 15 on the mandrel 2 ends and the carriage 7 stops. Rotation of the spindles 28 and 29 also stops.

Automatic operation of the apparatus is initiated by making corresponding switches at the control panel (not shown).

In the automatic operating mode the proposed apparatus functions as follows.

Pressing the "Start" push button at the control panel initiates rotation of the spindles 28 and 29 (the carriage 7 resting in the leftmost position). The power cylinder 30' exerts pressure on the collet clamp 3 to hold the spring 12 with the mandrel 1. The spindle 28 transmits torque to the mandrel 1 with the spring 12 being wound thereon. The mandrel 1 rotates to cause the wire 14 passing through the die 26 of the spring winding assembly 10 to be wound thereon.

When winding the last coil of the spring 12 between the step 20 of the stepped recess 18 and the wire 14 conveyed through the die 26 to the mandrel 1, a force is produced directed from the spindle 28 to the spindle 29. The assembly 10 transmits this force to the carriage 7.

The carriage 7 starts to travel along the guides 8 and 9 from the spindle 28 to the spindle 29 for the spring winding assembly 11 to remove the spring 13 from the mandrel 2 through the collet clamp 4 and hollow rod (not shown) of the power drive 31', and discharge it to a collecting bin (not shown).

When the carriage 7 assumes the rightmost position, a signal is fed to the power drive 28 to release the force from the collet clamp 3. The collet clamp 3 is unclasped to release the mandrel 1 with the spring 12 wound thereon. The spindle 28 stops transmitting torque to the mandrel 1 and spring 12.

The carriage stops in the rightmost position.

A signal is automatically issued to actuate the power drive 31' and transmit the force through the rod (not shown) to the collet clamp 4. The collet 4 clamps the spring 13 with the mandrel 2. The spindle 29 initiates transmission of torque to the mandrel 2 having the spring 13 wound thereon. The mandrel 2 rotates to take up the wire 15 passing through the die 27 of the spring winding assembly 11.

When winding the last coil of the spring 13, a force arises between the step 23 of the stepped recess 19 and the wire 15 conveyed through the die 27 onto the mandrel 2, this force being directed from the spindle 29 to the spindle 28. The spring winding assembly 11 imparts this force to the carriage 7.

The carriage 7 starts travelling along the guides 8 and 9 from the spindle 29 to the spindle 28 thereby causing the spring winding assembly 10 to remove from the mandrel 1 the spring 12 wound thereon through the collet 3 and hollow rod (not shown) of the power drive 30' and deliver it to a collecting bin (not shown).

When the carriage 7 assumes the leftmost position, a signal is fed to the power drive 31' to release the force from the collet clamp 4. The collet 4 is thereby unclasped to release the mandrel 2 with the spring 13 being wound thereon. The spindle 29 stops transmission of torque to the mandrel 2 and spring 13 being wound. The carriage 7 stops in the leftmost position.

A signal is issued to actuate the power cylinder 30 30', after which the cycle is repeated.

The modified form of the proposed apparatus with reference to FIG. 3 is intended for winding invariable pitch springs. This apparatus operates as follows.

Upon clamping the spring 35 with the mandrel 1 in the rotating collet clamp 3, the spring 35 and mandrel 1 initiate rotation along the inclined grooves 39 of the comb 38. A kinematic screw-nut pair is formed, in which the spring 35 with the mandrel 1 function as the screw, and the comb 28 with inclined grooves 39 function as the nut. Because the spring 35 with the mandrel 1 are held by the rotating collet clamp 3 and the comb 38 is mounted in the casing 37 secured on the carriage 7, the latter receives a rectilinear uniform motion as a result of the force arising during rotation of the spring on the inclined grooves 39 of the comb 38. In the course of spring coiling the grooves 39 of the comb 38 are subject to wear, which may lead to changing of the pitch of the spring 35.

In case of such pitch variations due to wear of the comb 38, the pitch is corrected by the movement of the slide 40 with the rod 41 secured thereon.

The die 43 of the rod 41 is set at a helix angle of the spring 35 to maintain continuity in the pitch of the spring 35 being wound.

The modification of the proposed apparatus shown in FIG. 5 operates in the following manner.

The rod 58 of the power cylinder 57 rests in the rightmost position. The U-shaped slide 47 stays in the same position accommodating the pressure insert 52 having the shoulder 54 and the pressure insert 53.

The spindle 28 imparts rotation to the spring 46 and mandrel 1, and the wire 14 is conveyed to the mandrel 1 through the die 56 of the rod 50 at the helix angle $\alpha$ of the spring 46.

In the course of coiling the spring 46 on the die 1 and during winding the last coil a force is produced between this last coil and shoulder 54 of the pressure insert 52 causing the carriage 7 to move to the right.

When it is necessary to change the pitch of the spring 46, a signal is delivered to move the rod 58 of the power cylinder 57 with the screw 59 to the right. The rod 58 of the power cylinder 57 is moved with the screw 59 to the right accompanied by the movement to the right of the U-shaped slide 47 to move the pressure inserts 52 and 53.

As the pressure insert 52 moves to the right, the die 56 of the rod 50 is turned about the axis C. This in turn causes changing of the helix angle $\alpha$ of the spring 46. Variation in the helix angle $\alpha$ of the spring 46 results in a change of pitch of this spring 46.

It is therefore the aim of the modified form of the proposed apparatus shown in FIG. 5 to make springs of variable pitch.

Figure 7:
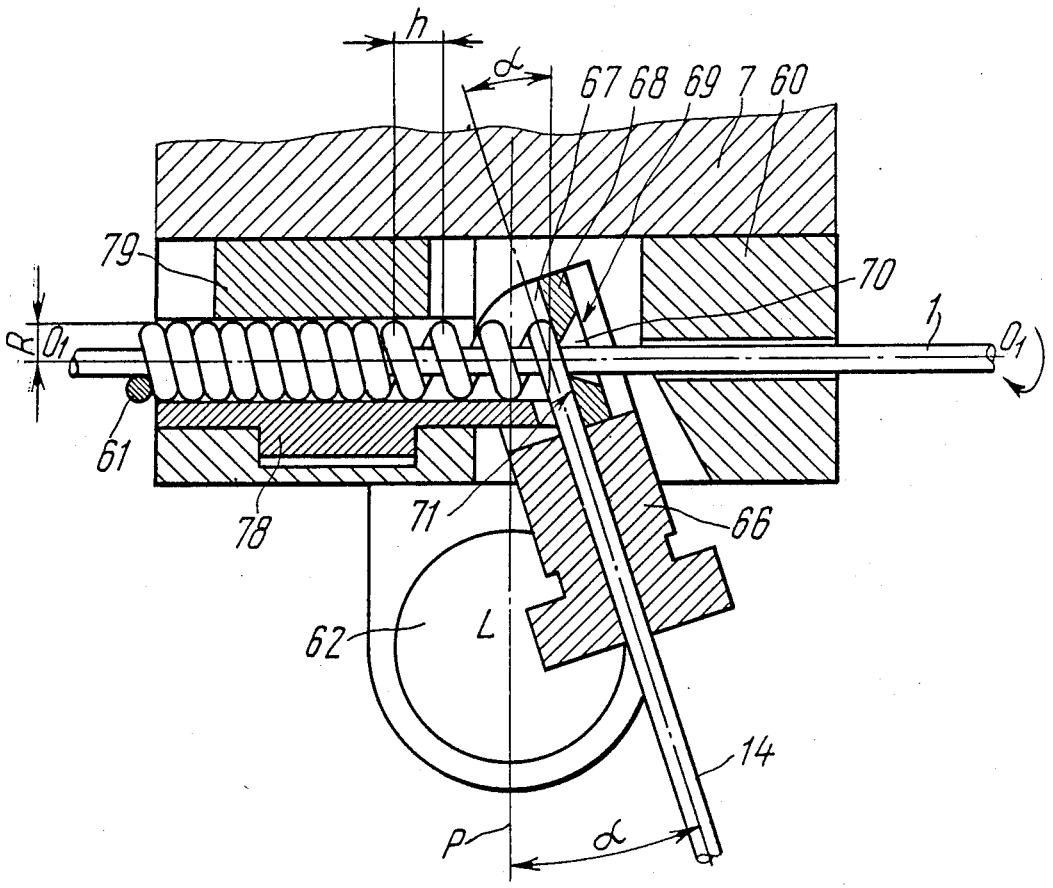
FIG. 7 is a section taken along the line VII—VII in FIG. 6.

The proposed apparatus embodied as illustrated in FIGS. 6 and 7 operates as follows.

The spring 61 wound onto the mandrel 1 and the mandrel 1 are placed between the bearing insert 77 and pressure insert 78 to prevent the horizontal movement of the spring 61. By its last coil the spring 61 bears on the surface 71 of the plate 68 arranged in the groove 67 of the dog 66 capable of turning about the axis N—N and changing the helix angle $\alpha$ of the spring 61. As the spring 61 and mandrel 1 rotate, coils of the wire 14 fed through the dog 66 at the helix angle $\alpha$ are wound on the mandrel 1.

Thereafter, as the spring 61 is being wound on the mandrel 1, a force directed rightwards arises between the last coil of the spring 61 and surface 71 of the plate 68 to cause the movement of the carriage 7 to the right. During the rightward movement of the carriage 7 the roller 72 of the pusher member 62 rolls on the working surface 65 of the follower 64 secured on the base 32.

Since the follower 64 has a shaped working surface 65 the roller 63, while rolling thereon through the axis 63', acts on the pusher member 62 to move it in the vertical direction. During the movement of the pusher member 62 its tapered part acts on the free end of the dog 66, which is caused to turn about its own axis N—N and change the helix angle $\alpha$ of the spring 61.

The apparatus represented in FIGS. 6 and 7 is therefore intended to make springs with smoothly varying coil pitch lengthwise of the spring 61.

The modified apparatus with reference to FIGS. 8 and 9 aims at extending the service life of the stop element.

This modification operates in the following manner.

While being wound onto the mandrel 1, the spring 76 cooperates with the roller 72 rotatable about its axis 73

(i.e., the last coil of the spring 76 engages with the outer cylindrical surface 75 of the roller 72).

A force directed rightwards arises between the cylindrical surface 75 of the roller 72 and the last coil of the spring 76. Therewith, the roller 72 engages with the wire 14 fed to the coiling zone and rotates. Under the action of this force the linear velocity of the surface 75 of the roller 72 equalizes with the feed rate of the wire 14 to the coiling zone.

Therefore, a nominally fixed contact is produced between the wire 14 fed to the coiling zone and working surface 75 of the roller 72 to result in a higher wear resistance of the stop element.

What is claimed is:

1. An apparatus for winding wire springs comprising:

a base;

a first collet clamp secured on said base;

a second collet clamp secured on said base;

a first sleeve secured on said base;

a second sleeve secured on said base;

a rotating drive of said first sleeve;

a rotating drive of said second sleeve;

a first mandrel for winding thereon a first spring from a first wire and having first and second ends;

a second mandrel for winding thereon a second spring from a second wire arranged in parallel with said first mandrel and having first and second ends;

said first mandrel being secured by its first end in said first collet clamp, and by its second end in said first sleeve;

a portion of said first mandrel having the first spring wound thereon;

said second mandrel being secured by its first end in said second sleeve, and by its second end in said second collet clamp;

a portion of said second mandrel having the second spring wound thereon;

a carriage arranged above said base;

a first assembly for winding said first spring from said first wire on said first mandrel arranged on said carriage for movement along said mandrels;

a casing of said first assembly for winding said first spring;

a recess accommodating said first mandrel and provided in said casing of said first spring winding assembly;

a first step made in said recess accommodating said first mandrel and having arranged thereon said portion of said mandrel having the first spring wound thereon;

a second step made in said recess accommodating said first mandrel;

a die of said first assembly for winding the first spring to direct the first wire onto said first mandrel;

an outlet hole of said die of said first assembly for winding the first spring provided at a boundary between said steps of said recess accommodating said first mandrel;

a first mechanism for setting the helix angle of said first spring from said first wire on said first mandrel and arranged in said recess of said casing of said first assembly for winding the first spring;

a second assembly for winding the second spring from said second wire on said second mandrel arranged on said carriage for movement along said mandrels, and having a casing for winding the second spring;

a recess accommodating said second mandrel and provided in the casing of the second assembly for winding the second spring;

a first step made in said recess accommodating the second mandrel and having arranged thereon said portion of said second mandrel having the second spring wound thereon;

a second step made in said recess accommodating said second mandrel;

a die of said second assembly for winding the second spring to direct the second wire onto said second mandrel;

an outlet hole of said die of said second assembly for winding the second spring provided at the boundary between said steps of said recess accommodating said second mandrel;

a second mechanism for setting the helix angle of said second spring from said second wire on said second mandrel and arranged in said recess of said casing of the second assembly for winding the second spring, said first and second mechanisms for setting the helix angles of the first and second springs, respectively, each comprising:

a comb arranged lengthwise of a respective mandrel and having a base;

an axis of said respective mandrel;

grooves of said comb arranged at an angle to a line perpendicular to the axis of said respective mandrel equal to the helix angle of a respective spring and at a pitch equal to the pitch of said respective spring;

a slide provided at the side of said base of said comb for reciprocations along said axis of said respective mandrel and having a body;

a drive for imparting reciprocations to said slide;

a cylindrical rod element having an axis of rotation and disposed in the body of said slide for free turning relative to its axis perpendicular to the axis of said respective mandrel; and a hole in said rod element arranged perpendicularly to the axis of rotation of said rod element and aligned in cross-section with said hole of said die of a respective assembly for winding the respective spring from the respective wire.

2. An apparatus as defined in claim 1, in which each said drive for imparting reciprocations to each said slide includes a lead screw locked in each said casing of each said spring winding assembly against longitudinal displacement, and a threaded connection linking said lead screw with each said slide.

3. An apparatus for winding wire springs comprising:

a base;

a first collet clamp secured on said base;

a second collet clamp secured on said base;

a first sleeve secured on said base;

a second sleeve secured on said base;

a rotating drive of said first sleeve;

a rotating drive of said second sleeve;

a first mandrel for winding thereon a first spring from a first wire and having first and second ends;

a second mandrel for winding thereon a second spring from a second wire arranged in parallel with said first mandrel and having first and second ends;

said first mandrel being secured by its first end in said first collet clamp, and by its second end in said first sleeve;

a portion of said first mandrel having the first spring wound thereon;

said second mandrel being secured by its first end in said second sleeve, and by its second end in said second collet clamp;

a portion of said second mandrel having the second spring wound thereon;

a carriage arranged above said base;

a first assembly for winding said first spring from said first wire on said first mandrel arranged on said carriage for movement along said mandrels;

a casing of said first assembly for winding said first spring;

a recess accommodating said first mandrel and provided in said casing of said first spring winding assembly;

a first step made in said recess accommodating said first mandrel and having arranged thereon said portion of said mandrel having the first spring wound thereon;

a second step made in said recess accommodating said first mandrel;

a die of said first assembly for winding the first spring to direct the first wire onto said first mandrel;

an outlet hole of said die of said first assembly for winding the first spring provided at a boundary between said steps of said recess accommodating said first mandrel;

a first mechanism for setting the helix angle of said first spring from said first wire on said first mandrel and arranged in said recess of said casing of said first assembly for winding the first spring;

a second assembly for winding the second spring from said second wire on said second mandrel arranged on said carriage for movement along said mandrels, and having a casing for winding the second spring;

a recess accommodating said second mandrel and provided in the casing of the second assembly for winding the second spring;

a first step made in said recess accommodating the second mandrel and having arranged thereon said portion of said second mandrel having the second spring wound thereon;

a second step made in said recess accommodating said second mandrel;

a die of said second assembly for winding the second spring to direct the second wire onto said second mandrel;

an outlet hole of said die of said second assembly for winding the second spring provided at the boundary between said steps of said recess accommodating said second mandrel;

a second mechanism for setting the helix angle of said second spring from said second wire on said second mandrel and arranged in said recess of said casing of the second assembly for winding the second spring, said first and second mechanisms for setting the helix angles of the first and second springs, respectively, each comprising:

a U-shaped slide capable of reciprocations along the axis of a respective mandrel;

a drive for imparting reciprocations to said U-shaped slide;

a recess made in said U-shaped slide;

a first pressure insert arranged in said recess of said U-shaped slide;

a cylindrical surface of said first pressure insert facing said respective mandrel;

end face of said first pressure insert;

a second pressure insert arranged in said recess of said U-shaped slide;

a cylindrical surface of said second pressure insert facing said respective mandrel;

an end face of said second pressure insert;

a bearing shoulder provided at said end face of one of said pressure inserts having a height equal to the diameter of a respective wire and cooperating with the last coil of a respective spring, the diameter of each of said pressure inserts being equal to the outside diameter of the respective spring;

a cylindrical rod element capable of free turning relative to its own axis perpendicular to the axis of said respective mandrel;

a hole in said rod element arranged perpendicularly to the axis of rotation of said rod element and aligned in cross-section with said hole of said die of a respective assembly for winding the respective spring from the respective wire.

4. An apparatus as defined in claim 3, in which said drive of the U-shaped slide comprises:

a power cylinder;

a rod of said power cylinder;

a screw provided in said rod and engageable with said end face of said U-shaped slide.

5. An apparatus for winding wire springs comprising:

a base;

a first collet clamp secured on said base;

a second collet clamp secured on said base;

a first sleeve secured on said base;

a second sleeve secured on said base;

a rotating drive of said first sleeve;

a rotating drive of said second sleeve;

a first mandrel for winding thereon a first spring from a first wire and having first and second ends;

a second mandrel for winding thereon a second spring from a second wire arranged in parallel with said first mandrel and having first and second ends;

said first mandrel being secured by its first end in said first collet clamp, and by its second end in said first sleeve;

a portion of said first mandrel having the first spring wound thereon;

said second mandrel being secured by its first end in said second sleeve, and by its second end in said second collet clamp;

a portion of said second mandrel having the second spring wound thereon;

a carriage arranged above said base;

a first assembly for winding said first spring from said first wire on said first mandrel arranged on said carriage for movement along said mandrels;

a casing of said first assembly for winding said first spring;

a recess accommodating said first mandrel and provided in said casing of said first spring winding assembly;

a first step made in said recess accommodating said first mandrel and having arranged thereon said portion of said mandrel having the first spring wound thereon;

a second step made in said recess accommodating said first mandrel;

a die of said first assembly for winding the first spring to direct the first wire onto said first mandrel;

an outlet hole of said die of said first assembly for winding the first spring provided at a boundary between said steps of said recess accommodating said first mandrel;

a first mechanism for setting the helix angle of said first spring from said first wire on said first mandrel and arranged in said recess of said casing of said first assembly for winding the first spring;

a second assemly for winding the second spring from said second wire on said second mandrel arranged on said carriage for movement along said mandrels, and having a casing for winding the second spring;

a recess accommodating said second mandrel and provided in the casing of the second assembly for winding the second spring;

a first step made in said recess accommodating the second mandrel and having arranged thereon said portion of said second mandrel having the second spring wound thereon;

a second step made in said recess accommodating said second mandrel;

a die of said second assembly for winding the second spring to direct the second wire onto said second mandrel;

an outlet hole of said die of said second assembly for winding the second spring provided at the boundary between said steps of said recess accommodating said second mandrel;

a second mechanism for setting the helix angle of said second spring from said second wire on said second mandrel and arranged in said recess of said casing of the second assembly for winding the second spring, the first and second mechanisms for setting the helix angles of the first and second springs, respectively, comprising:

a pusher member having first and second ends;

a tapered surface of said pusher member at its first end;

a roller provided at said second end of said pusher member to be capable of rotation about its own axis;

an outer cylindrical surface of said roller;

a follower having a working surface and continuously engaging by its working surface with said outer cylindrical surface of said roller;

a rotatable dog with an axis of rotation thereof perpendicular to the axis of a respective mandrel;

a first end of said rotatable dog to secure said rotatable dog in a cantilever fashion in said casing of a respective assembly for winding a respective spring;

a second end of said rotatable dog to ensure continuous engagement of said rotatable dog with said tapered surface of said pusher member;

a longitudinal groove made in said rotatable dog;

a stop element arranged in said longitudinal groove, cooperating with the last coil of the respective spring, and transmitting a force from the respective spring to being wound to said casing of said respective assembly for winding the respective spring.

6. An apparatus as defined in claim 5, in which each said stop element has the form of a plate accommodated in said groove of said rotatable dog, adjoining by one surface thereof the inner surface of said groove, and having a tapered hole for accommodating said corresponding mandrel, the axis of rotation of said dog coinciding with the axis of said mandrel.

7. An apparatus as claimed in claim 5, in which each said stop element has the form of a roller secured in a casing of said dog and having a center of rotation spaced from the axis of rotation of said dog at a distance equal to the radius of said roller an end face of which is spaced from the axis of said corresponding mandrel at a distance equal to the radius of this mandrel, whereas a cylindrical surface thereof engages with the last coil of the corresponding spring.

* * * * *